US012035751B2

(12) United States Patent
Qiu et al.

(10) Patent No.: US 12,035,751 B2
(45) Date of Patent: Jul. 16, 2024

(54) ATOMIZING HEAD, ATOMIZER AND ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Hongjun Zhang, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 534 days.

(21) Appl. No.: 17/346,302

(22) Filed: Jun. 14, 2021

(65) Prior Publication Data

US 2021/0298361 A1 Sep. 30, 2021

Related U.S. Application Data

(63) Continuation-in-part of application No. PCT/CN2019/120201, filed on Nov. 22, 2019.

(30) Foreign Application Priority Data

Dec. 13, 2018 (CN) ..... 201822094247.0

(51) Int. Cl.
*A24F 40/46* (2020.01)
*A24F 40/10* (2020.01)

(52) U.S. Cl.
CPC ..... *A24F 40/46* (2020.01); *A24F 40/10* (2020.01)

(58) Field of Classification Search
CPC ..... A24F 40/46; A24F 40/10; A24F 40/44
See application file for complete search history.

(56) References Cited

U.S. PATENT DOCUMENTS

2015/0059787 A1 3/2015 Qiu
2016/0192710 A1 7/2016 Liu
2017/0006922 A1 1/2017 Wang et al.
2017/0188626 A1 7/2017 Davis et al.
2017/0251729 A1* 9/2017 Li ..... A24F 40/485
(Continued)

FOREIGN PATENT DOCUMENTS

CN 205567817 U 9/2016
CN 206547878 U 10/2017
(Continued)

OTHER PUBLICATIONS

The extended European search report of EP application No. 19894706.1 issued on Jun. 1, 2022.

*Primary Examiner* — Truc T Nguyen
(74) *Attorney, Agent, or Firm* — Andrew C. Cheng

(57) ABSTRACT

Disclosed are an atomizing head, an atomizer, and an electronic cigarette. The atomizing head includes a contacting member, an atomizing core and a core seat, wherein an atomizing cavity is formed in the core seat, the atomizing core is connected to the core seat, the atomizing core is a porous ceramic body, the atomizing core is provided with a conductive member, and the contacting member is in contact with the conductive member so as to realize an electrical connection between the contacting member and the atomizing core. The atomizing head, the atomizer and the electronic cigarette are easily assembled, thereby improving the assembly efficiency and reducing the production cost.

16 Claims, 4 Drawing Sheets

(56) References Cited

U.S. PATENT DOCUMENTS

| | | | | |
|---|---|---|---|---|
| 2017/0311384 | A1* | 10/2017 | Wu | A61M 11/042 |
| 2017/0325504 | A1* | 11/2017 | Liu | A61M 11/042 |
| 2018/0289065 | A1* | 10/2018 | Liao | A24F 7/04 |
| 2019/0090543 | A1* | 3/2019 | Qiu | A24F 40/46 |
| 2019/0216135 | A1* | 7/2019 | Guo | A24F 40/44 |
| 2020/0214361 | A1* | 7/2020 | Zhao | H05B 3/44 |
| 2021/0298361 | A1* | 9/2021 | Qiu | A24F 40/44 |
| 2021/0321670 | A1* | 10/2021 | Chen | A24F 40/485 |
| 2021/0321671 | A1* | 10/2021 | Chen | A24F 40/10 |
| 2023/0092179 | A1* | 3/2023 | He | H05B 3/26 131/329 |
| 2023/0210174 | A1* | 7/2023 | Xiujin | A24F 7/02 131/329 |

FOREIGN PATENT DOCUMENTS

| | | | |
|---|---|---|---|
| CN | 207821092 | U | 9/2018 |
| CN | 207897893 | U | 9/2018 |
| CN | 209546930 | U | 10/2019 |
| EP | 2965641 | A1 | 1/2016 |

* cited by examiner

ATOMIZING HEAD, ATOMIZER AND ELECTRONIC CIGARETTE

CROSS-REFERENCE TO RELATED APPLICATIONS

This application is a continuation-in-part of International Patent Application No. PCT/CN2019/120201, filed on Nov. 22, 2019, entitled "atomizing head, atomizer and electronic cigarette", which claims priority to Chinese Patent Application No. 201822094247.0, filed on Dec. 13, 2018. All of the aforementioned patent applications are hereby incorporated by reference in their entireties.

TECHNICAL FIELD

The disclosure relates to the technical field of simulated smoking, and more particularly, relates to an atomizing head, an atomizer, and an electronic cigarette.

BACKGROUND

An electronic cigarette is an electronic product that simulates smoking. It generates smoke by heating the e-liquid. The smoke has a similar taste to cigarettes. The user simulates the feeling of smoking by inhaling the smoke generated by the electronic cigarette. Inside of the existing electronic cigarettes, the e-liquid is usually transferred to the heating wire through the cotton. This method uses the principle of capillary infiltration to store the e-liquid in the cotton, which is easy to cause liquid leakage, and in the process of atomization of the e-liquid, it is easy to cause dry burning and even scorch the cotton and produces a peculiar smell, resulting in a poor taste of the smoke. In addition, the method of using the heating wire to conduct electricity and heat to atomize the e-liquid has a complicated structure and low atomizing efficiency.

SUMMARY

The technical problem to be solved by the disclosure is to provide an atomizing head, an atomizer, and an electronic cigarette, which can effectively guide liquid without liquid leakage and has a simple structure, which is conducive to improving the atomization efficiency and the taste of the smoke.

The technical solution adopted by the present disclosure to solve its technical problem is as follows.

An atomizing head includes a contacting member, an atomizing core and a core seat, wherein an atomizing cavity is formed in the core seat, the atomizing core is connected to the core seat, the atomizing core is a porous ceramic body, a conductive member is provided on the atomizing core, the contacting member is in contact with the conductive member to realize an electrical connection between the contacting member and the atomizing core.

In one embodiment, the conductive member not only has a conductive function, but also has a heating function, wherein the conductive member comprises an internal circuit, when the contacting member is in contact with the conductive member, the contacting member is electrically connected to the internal circuit, the internal circuit has a certain resistance, and the conductive member generates heat when energized.

In one embodiment, the conductive member has only a conductive function and does not have a heating function, wherein there are at least two separate current channels in the conductive member, a heating element is provided inside the atomizing core, the heating element has a certain resistance, and the heating element generates heat when energized; one end of the heating element is electrically connected to one current channel in the conductive member, and the other end of the heating element is electrically connected to the other current channel in the conductive member; when the contacting member is in contact with the conductive member, the conductive member is electrically connected to the heating element.

In one embodiment, the core seat is provided with a through hole, the through hole is configured to install the atomizing core, and the through hole is in communication with the atomizing cavity; when the atomizing core is inserted in the through hole and installed on the core seat, the atomizing core is at least partially received in the atomizing cavity.

In one embodiment, the core seat is further provided with an air guiding hole, the air guiding hole is in communication with the atomizing cavity and the outside air; one end of the air guiding hole brings the outside air into the atomizing cavity; after the atomizing core heats and atomizes the e-liquid to form smoke, the smoke in the atomizing cavity is discharged from the other end of the air guiding hole.

In one embodiment, the core seat is further provided with a liquid inlet passage, the liquid inlet passage is provided on an outer surface of the core seat, and the liquid inlet passage is in communication with the liquid storage cavity and the through hole.

In one embodiment, the liquid inlet passage is provided on an upper end surface of the core seat along an axial direction of the core seat.

In one embodiment, the atomizing head further includes a base, the base is connected to the core seat; the base is provided with a mounting hole, the contacting member is inserted in the mounting hole; the base is further provided with an air inlet passage in communication with the air guiding hole.

In one embodiment, an upper end surface of the base is provided with a groove, the bottom of the core seat is provided with an inserting block, and the inserting block is inserted into the groove.

In one embodiment, the core seat is provided with a first side surface, a second side surface, a third side surface and a fourth side surface, the area of the first side surface and the second side surface is smaller than that of the third side surface and the fourth side surface, a gap is formed between the first side surface or the second side surface and an inner wall of the liquid storage cavity, while the third side surface and the fourth side surface tightly abut against the inner wall of the liquid storage cavity, the through hole extends through the first side surface and the second side surface of the core seat in a direction perpendicular to an axial direction of the core seat.

In one embodiment, the conductive member is arranged on a surface of the atomizing core.

In one embodiment, the conductive member is arranged on the bottom surface of the atomizing core.

In one embodiment, the conductive member is a conductive metal layer provided on the surface of the atomizing core.

An atomizer includes a liquid storage member and an atomizing head as mentioned above; a liquid storage cavity is provided in the liquid storage member, the liquid storage cavity is configured for storing e-liquid; the atomizing head is connected to the liquid storage member, and the atomizing head is at least partially received in the liquid storage cavity.

In one embodiment, the atomizer further comprises an air guiding tube, one end of the air guiding tube is connected to the liquid storage member, and the other end of the air guiding tube is connected to the core seat, so that the other end of the air guiding tube is in communication with the atomizing cavity; the e-liquid in the liquid storage member is heated and atomized by the atomizing core to form smoke, the smoke is discharged through the air guiding tube for inhalation.

In one embodiment, the atomizer further includes a mouthpiece, the mouthpiece is connected to one end of the liquid storage member opposite to the atomizing head, the smoke in the air guiding tube is discharged through the mouthpiece.

In one embodiment, the liquid storage member is provided with a liquid injecting hole, the liquid injecting hole is provided between the liquid storage member and the mouthpiece, a liquid injecting plug is inserted into the liquid injecting hole to seal the liquid injecting hole.

In one embodiment, the atomizer further includes a metal cover, the metal cover is sleeved on the bottom end of the liquid storage member.

An electronic cigarette includes a battery assembly and an atomizer as mentioned above; the battery assembly comprises a casing and a battery placed inside the casing, the battery is electrically connected to the contacting member, the casing and the atomizer are detachably connected.

In one embodiment, a supporting frame is provided in the casing, a first magnet is connected to the supporting frame, the atomizer and the battery assembly are in close contact through the attraction force of the first magnet.

The beneficial effects of the present disclosure are as follows:

In the electronic cigarette provided by the present disclosure, the atomizing core is a porous ceramic body, the porous ceramic body has the function of absorbing the e-liquid, the e-liquid absorbed by the porous ceramic body will not leak. The contacting member of the atomizing core and the conductive member are in contact with each other to realize the electrical connection between the atomizing core and the contacting member. The assembly is simple, the assembly efficiency is improved, and the production cost is reduced.

Figure 1:
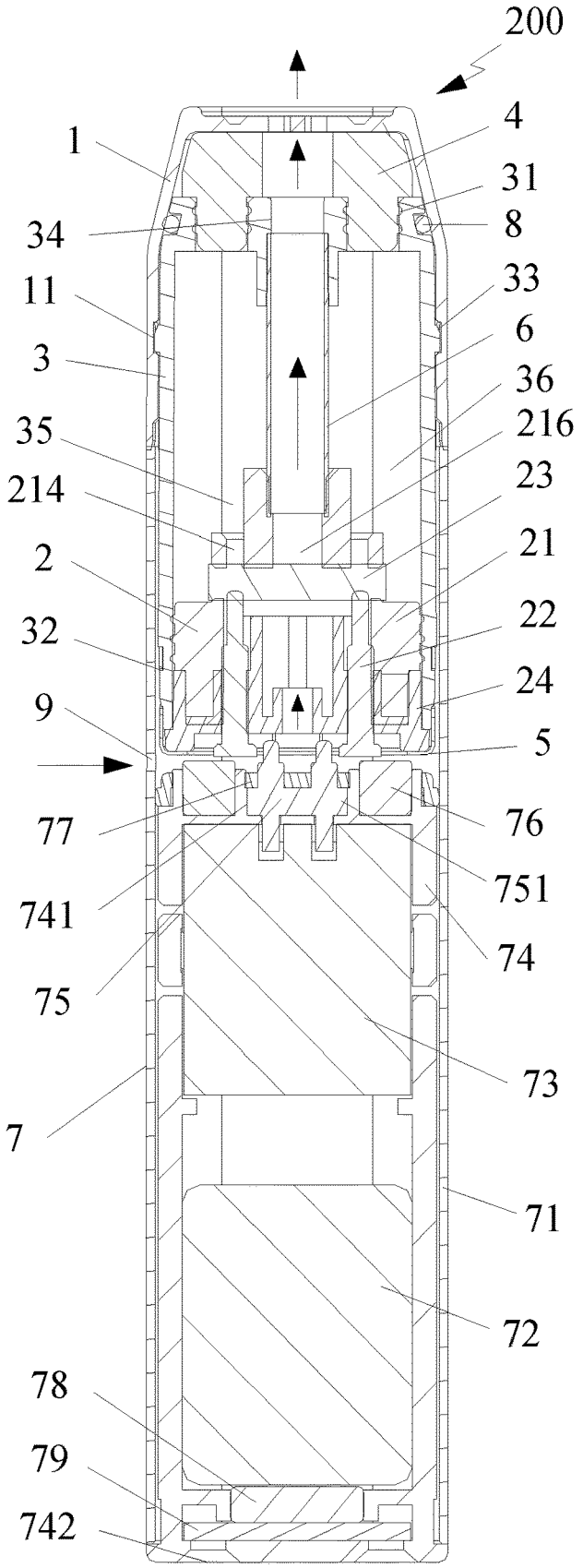
FIG. 1 is a schematic diagram of the electronic cigarette of the present disclosure.

In the drawings, the various components and reference numerals are as follows.

| | |
|---|---|
| mouthpiece 1 | connecting hole 34 |
| inserting groove 11 | mounting opening 35 |
| atomizing head 2 | liquid storage cavity 36 |
| core seat 21 | liquid injecting plug 4 |
| sealing protrusion 211 | metal cover 5 |
| through hole 212 | inserting hole 51 |
| air guiding hole 213 | air guiding tube 6 |
| liquid inlet passage 214 | battery assembly 7 |
| inserting block 215 | casing 71 |
| atomizing cavity 216 | battery 72 |
| first side surface 217 | PCBA board 73 |

-continued

| | |
|---|---|
| second side surface 218 | supporting frame 74 |
| third side surface 219 | latching groove 741 |
| fourth side surface 220 | charging terminal 742 |
| contacting member 22 | battery terminal 75 |
| atomizing core 23 | limiting protrusion 751 |
| conductive member 231 | first magnet 76 |
| base 24 | limiting plate 77 |
| mounting hole 241 | second magnet 78 |
| groove 242 | charging circuit board 79 |
| air inlet passage 243 | sealing ring 8 |
| liquid storage member 3 | air inlet hole 9 |
| liquid injecting hole 31 | atomizer 100 |
| first protrusion 32 | electronic cigarette 200 |
| second protrusion 33 | |

DETAILED DESCRIPTION OF PREFERRED EMBODIMENTS

The present disclosure is further described in combination with the drawings and specific embodiments, so that those skilled in the art can better understand the present disclosure and implement it, but the embodiments are not taken as the limitation of the present disclosure.

Figure 2:
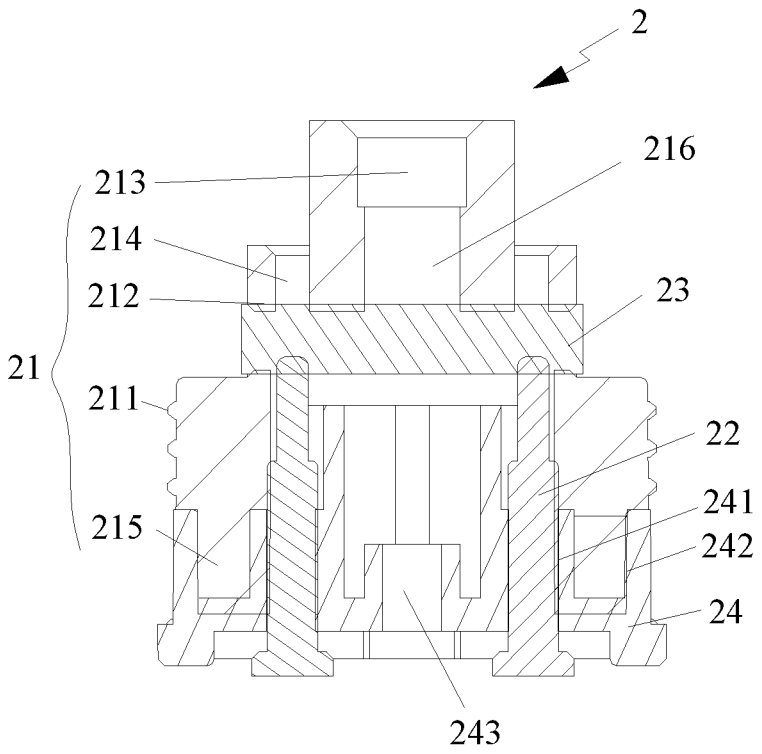
FIG. 2 is a cross-sectional view of the atomizing head in FIG. 1.

As shown in FIGS. 1 to 2, this embodiment discloses an electronic cigarette 200, which includes a battery assembly 7 and an atomizer 100 electrically connected to the battery assembly 7. Under the electric driving of the battery assembly 7, the atomizer 100 heats the e-liquid to atomize the e-liquid and form smoke.

Figure 5:
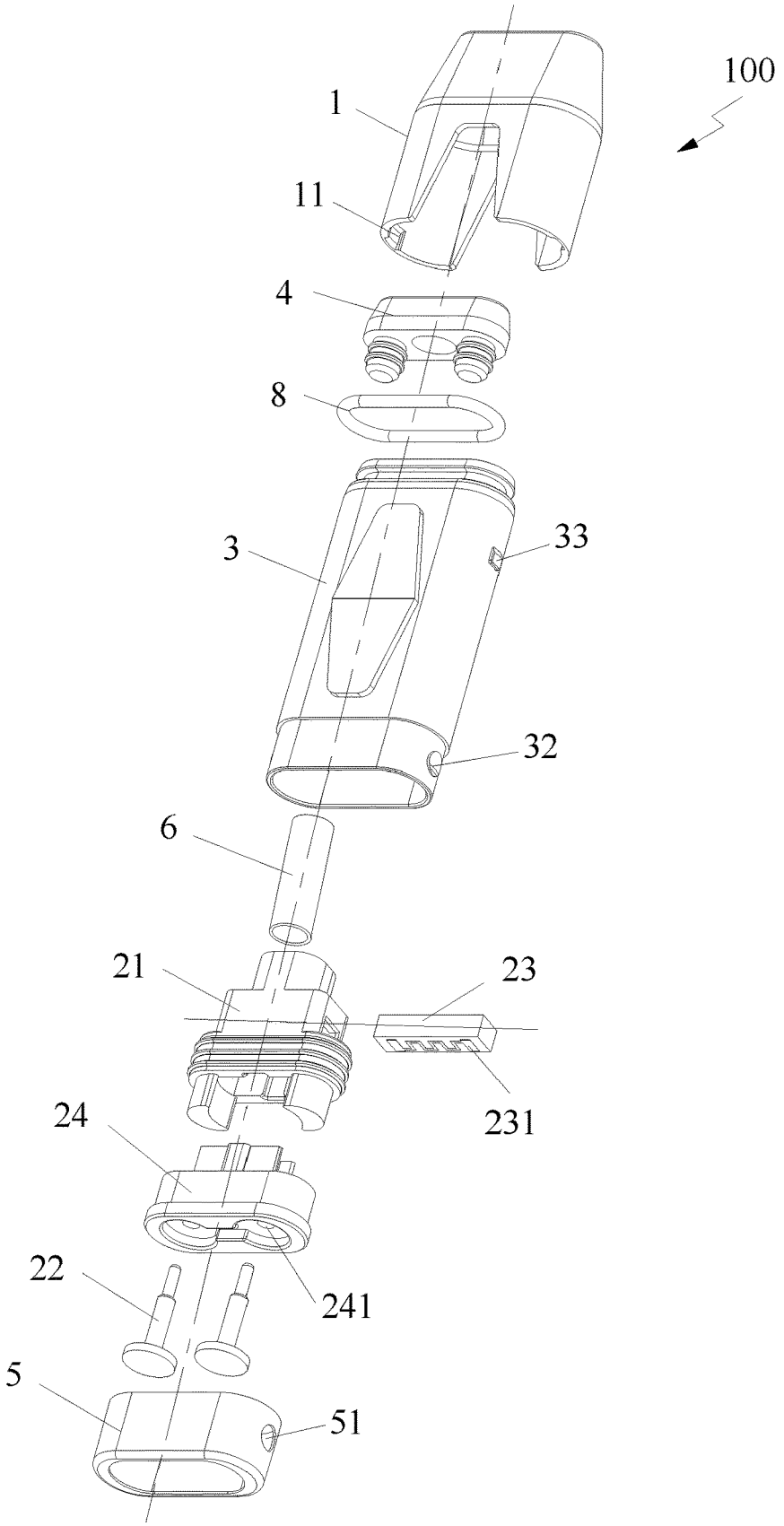
FIG. 5 is an exploded, schematic diagram of the atomizer in FIG. 1.

As shown in FIGS. 1 and 5, the atomizer 100 includes a liquid storage member 3 and an atomizing head 2. A liquid storage cavity 36 is provided in the liquid storage member 3. The liquid storage cavity 36 is configured for storing e-liquid. The atomizing head 2 is connected to the liquid storage member 3, and the atomizing head 2 is at least partially received in the liquid storage cavity 36. In one of the embodiments, a mounting opening 35 is provided at one end of the liquid storage member 3, and the mounting opening 35 is communicated with the liquid storage cavity 36. The atomizing head 2 is connected to one end of the liquid storage member 3 with the mounting opening 35.

The atomizing head 2 includes a contacting member 22 and an atomizing core 23. The atomizing core 23 is a porous ceramic body. A conductive member 231 is provided on the atomizing core 23. The contacting member 22 is in contact with the conductive member 231 to realize the electrical connection between the contacting member 22 and the atomizing core 23.

The atomizing core 23 is a porous ceramic body, an inside of the porous ceramic body has open pores, and the open pores have capillary action. Therefore, the porous ceramic body has the function of absorbing the e-liquid and effectively avoids the phenomenon of dry burning. When the open pores in the porous ceramic body are saturated, the porous ceramic body will not absorb more e-liquid, and the e-liquid absorbed by the porous ceramic body will not leak without external force such as squeezing.

The conductive member 231 is arranged on the surface of the atomizing core 23. In one of the embodiments, the conductive member 231 is arranged on the bottom surface of the atomizing core 23. It can be understood that, in other embodiments, the conductive member may be arranged on the side surface or the top surface of the atomizing core 23.

The conductive member 231 is a conductive metal layer provided on the surface of the atomizing core 23. The conductive metal layer can be provided on the surface of the atomizing core 23 by reduction method, chemical vapor deposition, surface coating, vacuum metallization, thermal spraying or pasting, etc. The conductive member 231 has a conductive function.

In one of the embodiments, the conductive member 231 not only has a conductive function, but also has a heating function, wherein the conductive member 231 includes an internal circuit, when the contacting member 22 is in contact with the conductive member 231, the contacting member 22 is electrically connected to the internal circuit, the internal circuit has a certain resistance, and the conductive member 231 generates heat when energized. In another embodiment, the conductive member 231 has only a conductive function and does not have a heating function, wherein there are at least two separate current channels in the conductive member 231, a heating element (not shown) is provided inside the atomizing core 23, the heating element has a certain resistance, and the heating element generates heat when energized. One end of the heating element is electrically connected to one current channel in the conductive member 231, and the other end of the heating element is electrically connected to the other current channel in the conductive member 231. When the contacting member 22 is in contact with the conductive member 231, the conductive member 231 is electrically connected to the heating element.

The contacting member 22 is in contact with the conductive member 231 to realize the electrical connection between the contacting member 22 and the atomizing core 23. The contacting member 22 is made of a conductive material, wherein the conductive material includes, but is not limited to, metal, alloy or composite metal, etc. Further, the contacting member 22 has elasticity, so that the contacting member 22 always tightly abuts against the conductive member 231, thereby improving the stability of electrical connection between the atomizing core 23 and the contacting member 22.

Conventionally, the heating element is electrically connected to the contacting member 22 through lead wires, such as by clamping, welding, etc., and the electrical connection between the heating element and the contacting member 22 leads to a complicated assembly process and poor consistency after being assembled. Compared with the conventional electrical connection method between the heating element and the contacting member 22, in this embodiment, the contacting member 22 is in contact with the conductive member 231 on the atomizing core 23 to realize the electrical connection, which is simple to assemble and can improve the assembly efficiency. The atomizing head 2 further includes a core seat 21, the core seat 21 is arranged at one end of the liquid storage member 3 with the mounting opening 35, and the core seat 21 is at least partially received in the liquid storage cavity 36.

The atomizing core 23 is installed on the core seat 21. An atomizing cavity 216 is formed in the core seat 21, the core seat 21 is provided with a through hole 212, the through hole 212 is configured to install the atomizing core 23, and the through hole 212 is in communication with the atomizing cavity 216. When the atomizing core 23 is inserted in the through hole 212 and installed on the core seat 21, the atomizing core 23 is at least partially received in the atomizing cavity 216.

The through hole 212 is provided on the side surface of the core seat 21. After the atomizing core 23 is inserted in the through hole 212, the contact surface of the atomizing core 23 and the air in the atomizing cavity 216 is large, and the atomizing effect of the atomizing core 23 is improved. The side surfaces of the core seat 21 is composed of a first side surface 217, a second side surface 218, a third side surface 219, and a fourth side surface 220. A gap is formed between the first side surface 217 or the second side surface 218 and the inner wall of the liquid storage cavity 36, while the third side surface 219 and the fourth side surface 220 tightly abut against the inner wall of the liquid storage cavity 36. In this embodiment, the area of the first side surface 217 and the second side surface 218 is smaller than that of the third side surface 219 and the fourth side surface 220.

In one of the embodiments, the through hole 212 is provided on the first side surface 217 and/or the second side surface 218. The atomizing core 23 is inserted into the through hole 212. The atomizing core 23 is in contact with the e-liquid in the liquid storage cavity 36. The atomizing core 23 absorbs the e-liquid in the liquid storage cavity 36 through the through hole 212. Further, the through hole 212 extends through the first side surface 217 and the second side surface 218 of the core seat 21 in a direction perpendicular to the axial direction of the core seat 21, so that the through hole 212 not only facilitates the installation of the atomizing core 23, but also makes the atomizing core 23 easy to absorb the e-liquid in the liquid storage cavity 36. Furthermore, the core seat 21 is further provided with a liquid inlet passage 214, the liquid inlet passage 214 is provided on the outer surface of the core seat 21, and the liquid inlet passage 214 is in communication with the liquid storage cavity 36 and the through hole 212. When the atomizing core 23 is inserted into the through hole 212, the e-liquid in the liquid storage cavity 36 contacts with the atomizing core 23 through the liquid inlet passage 214, so that the atomizing core 23 absorbs the e-liquid in the liquid storage cavity 36 through the through hole 212 and the liquid inlet passage 214 simultaneously. In one of the embodiments, the liquid inlet passage 214 is provided on the upper end surface of the core seat 21 along the axial direction of the core seat 21.

In another embodiment, the through hole 212 is provided on the third side surface 219 and/or the fourth side surface 220, the atomizing core 23 is inserted into the through hole 212, while the atomizing core 23 cannot absorb the e-liquid in the liquid storage cavity 36 through the through hole 212. Furthermore, the core seat 21 is further provided with a liquid inlet passage 214, the liquid inlet passage 214 is provided on the outer surface of the core seat 21, and the liquid inlet passage 214 is in communication with the liquid storage cavity 36 and the through hole 212. When the atomizing core 23 is inserted into the through hole 212, the e-liquid in the liquid storage cavity 36 contacts with the atomizing core 23 through the liquid inlet passage 214, so that the atomizing core 23 absorbs the e-liquid in the liquid storage cavity 36 through the liquid inlet passage 214.

The core seat 21 is further provided with an air guiding hole 213, the air guiding hole 213 is in communication with the atomizing cavity 216 and the outside air. One end of the air guiding hole 213 brings the outside air into the atomizing cavity 216. After the atomizing core 23 heats and atomizes the e-liquid to form smoke, the smoke in the atomizing cavity 216 is discharged from the other end of the air guiding hole 213. In one of the embodiments, the air guiding hole 213 extends through the upper end surface and the lower end surface of the core seat 21 along the axial direction of the core seat 21.

Figure 3:
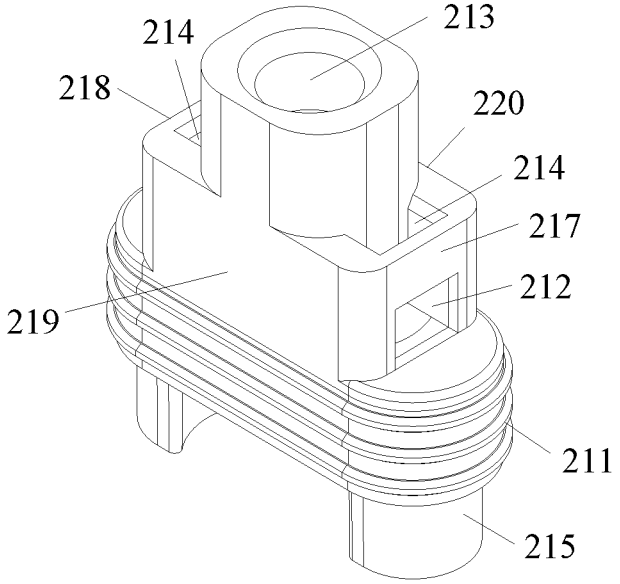
FIG. 3 is a schematic diagram of the core seat in FIG. 2.
Figure 4:
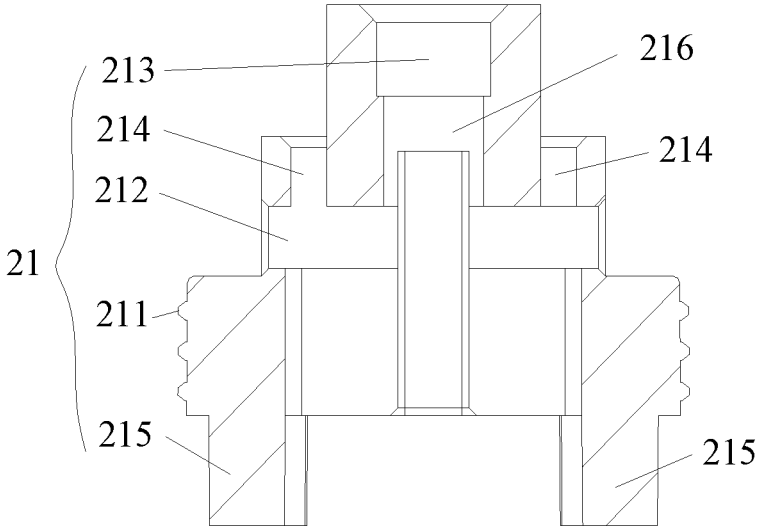
FIG. 4 is a cross-sectional view of the core seat in FIG. 2.

As shown in FIGS. 3 to 4, the lower end of the core seat 21 is also provided with a sealing protrusion 211, the outer wall of the sealing protrusion 211 tightly abuts against the inner wall of the liquid storage cavity 36 to provide a better sealing effect to the e-liquid in the liquid storage cavity 36.

The material of the core seat 21 includes, but is not limited to, silicone, rubber, or polyurethane.

In one of the embodiments, the core seat 21 can use silicone, which is chemically stable, does not easily react with other substances, and has good thermal stability.

The atomizing head 2 further includes a base 24, and the base 24 is connected to the core seat 21. The base 24 is provided with a mounting hole 241, and the contacting member 22 is inserted in the mounting hole 241. The mounting hole 241 and the contacting member 22 can be connected by interference fit, threaded connection, or bonding to realize the connection between the contacting member 22 and the base 24. In this embodiment, the mounting hole 241 and the contacting member 22 are connected by interference fit. In other embodiments, the atomizing head 2 further includes an elastic member (not shown), one end of the elastic member abuts against the base 24, the other end of the elastic member abuts against the contacting member 22, so that the contacting member 22 always tightly abuts against the conductive member 231, thereby improving the stability of electrical connection between the atomizing core 23 and the contacting member 22.

The base 24 is further provided with an air inlet passage 243 in communication with the air guiding hole 213.

The upper end surface of the base 24 is provided with a groove 242, the bottom of the core seat 21 is provided with an inserting block 215, and the inserting block 215 is inserted into the groove 242. This connection method is more convenient for assembly and disassembly.

The base 24 and the liquid storage member 3 are connected by interference fit. Specifically, the outer wall of the base 24 is in interference fit with the inner wall of the liquid storage cavity 36. It can be understood that the base 24 and the liquid storage member 3 can be connected by snapping, bonding or welding, etc. to realize the connection between the base 24 and the liquid storage member 3.

It can be understood that, in other embodiments not shown, the core seat 21 and the base 24 can be integrally formed.

The atomizer 100 further includes a mouthpiece 1, and the mouthpiece 1 is connected to one end of the liquid storage member 3 opposite to the mounting opening 35. That is, the mouthpiece 1 is connected to the end of the liquid storage member 3 opposite to the atomizing head 2. It can be understood that, in other embodiments, the mouthpiece 1 and the liquid storage member 3 can be integrally formed.

The external air enters the inside of the base 24 through the air inlet passage 243, then enters the atomizing cavity 216 through one end of the air guiding hole 213, and then enters the mouthpiece 1 through the other end of the air guiding hole 213.

The mouthpiece 1 and the liquid storage member 3 can be connected by interference fit, or by locking. When they are connected by locking, a second protrusion 33 is provided on the outer wall of the liquid storage member 3, an inserting groove 11 is provided on the inner wall of the mouthpiece 1, and the second protrusion 33 is inserted into the inserting groove 11. In order to ensure the tightness, a sealing ring 8 is further connected between the liquid storage member 3 and the mouthpiece 1.

The liquid storage member 3 is provided with a liquid injecting hole 31. A liquid injecting plug 4 is connected to the liquid injecting hole 31. The liquid injecting hole 31 is provided between the liquid storage member 3 and the mouthpiece 1. It can be understood that, when installing, the e-liquid is first injected into the liquid storage cavity 36 through the liquid injecting hole 31, and then the liquid injecting plug 4 is inserted into the liquid injecting hole 31 to seal the liquid injecting hole 31, and then the mouthpiece 1 is locked on the liquid storage member 3.

The atomizer 100 further includes an air guiding tube 6 in communication with the atomizing cavity 216, one end of the air guiding tube 6 is connected to the liquid storage member 3, and the other end of the air guiding tube 6 is connected to the core seat 21, so that the other end of the air guiding tube 6 is in communication with the atomizing cavity 216. The e-liquid in the liquid storage member 3 is heated and atomized by the atomizing core 23 to form smoke, the smoke enters the mouthpiece 1 through the air guiding tube 6 and is then discharged for inhalation.

In one of the embodiments, the liquid storage member 3 is provided with a connecting hole 34, and the core seat 21 is provided with an air guiding hole 213. One end of the air guiding tube 6 is inserted in the connecting hole 34 and connected to the connecting hole 34 by an interference fit, and the other end of the air guiding tube 6 is inserted in the air guiding hole 213 and connected to the air guiding hole 213 by an interference fit. This connection method is reliable in connection, has good sealing effect, can better avoid air leakage, and at the same time, is convenient for installation and disassembly.

The battery assembly 7 includes a casing 71, and a battery 72 placed inside the casing 71. The battery 72 is electrically connected to the contacting member 22.

Inside the casing 71, there are further provided with a PCBA (printed circuit board assembly) board 73 connected to the battery 72, a supporting frame 74, and a battery terminal 75. A latching groove 741 is provided on the supporting frame 74, the battery terminal 75 is mounted in the latching groove 741. One end of the battery terminal 75 is electrically connected to the contacting member 22, and the other end of the battery terminal 75 is electrically connected to the PCBA board 73. A sensor switch (not shown) is integrated in the PCBA board 73. The battery assembly 7 and the atomizer 100 can be detachably connected, for example, by magnetic attraction, snapping connection, screw connection, etc.

In one of the embodiments, the battery assembly 7 and the atomizer 100 are connected by magnetic attraction, and a first magnet 76 is connected to the supporting frame 74. The attraction force of the first magnet 76 attracts the atomizer 100, to ensure that the atomizer 100 and the battery assembly 7 are in close contact, prevent the atomizer 100 from being separated from the battery assembly 7 and ensure good contact between the contacting member 22 of the atomizer 100 and the battery terminal 75. The atomizer 100 further includes a metal cover 5. The metal cover 5 is sleeved on one end of the liquid storage member 3 with the base 24. The metal cover 5 and the liquid storage member 3 can be connected by interference fit, or by locking. When they are connected by locking, a first protrusion 32 is provided on the outer wall of the liquid storage member 3, an inserting hole 51 is provided on the metal cover 5, and the first protrusion 32 is inserted into the insertion hole 51.

An air inlet hole 9 is provided on the side wall of the casing 71, and the air inlet hole 9 is in communication with the outside air and the air inlet passage 243.

A limiting plate 77 is further connected to the supporting frame 74, a limiting protrusion 751 is provided on the side wall of the battery terminal 75. The limiting plate 77 presses against the limiting protrusion 751 to prevent the battery terminal 75 from slipping off.

The battery 72 is electrically connected to the charging circuit board 79. The charging circuit board 79 and the charging terminal 742 are electrically connected. The charging circuit board 79 and the charging terminal 742 are arranged at the bottom end of the supporting frame 74. Specifically, the charging circuit board 79 is a printed circuit board, that is, a PCB board.

A second magnet 78 is disposed at the bottom end of the supporting frame 74, and the second magnet 78 is configured to realize a magnetic connection between the battery assembly 7 and a charging base (not shown).

The installation process of the atomizer 100 is as follows:

Step a: installing the atomizing core 23. The atomizing core 23 is installed on the core seat 21 by inserting into the through hole 212, and the atomizing core 23 is at least partially received in the atomizing cavity 216.

Step b: connecting the base 24 and the core seat 21. The inserting block 215 at the bottom of the core seat 21 is inserted into the groove 242 in the base 24.

Step c: installing the contacting member 22. The contacting member 22 is inserted into the mounting hole 241 in the base 24. The contacting member 22 is in contact with the conductive member 231 on the atomizing core 23. The mounting hole 241 is in an interference fit with the contacting member 22.

Step d: installing the air guiding tube 6. The lower end of the air guiding tube 6 is connected to the air guiding hole 213 in the core seat 21.

Step e: installing the liquid storage member 3. The assembly being assembled in steps a to d is connected to one end of the liquid storage member 3 with the mounting opening 35. The upper end of the air guiding tube 6 is inserted in the connecting hole 34 of the liquid storage member 3, and the upper end of the air guiding tube 6 is in an interference fit with the connecting hole 34. The outer wall of the sealing protrusion 211 of the core seat 21 tightly abuts against the inner wall of the liquid storage cavity 36. The outer wall of the base 24 is in an interference fit with the inner wall of the liquid storage cavity 36.

Step f: injecting e-liquid. The assembly obtained in step e is placed upright so that the liquid injecting hole 31 in the liquid storage member 3 faces upwards, the e-liquid is injected into the liquid storage cavity 36 through the liquid injecting hole 31 of the liquid storage member 3, and then, the liquid injection plug 4 is inserted into the liquid injecting hole 31 to seal the liquid injecting hole 31.

Step g: installing the mouthpiece 1. The assembly obtained in step f is locked with the mouthpiece 1, i.e., the second protrusion 33 on the liquid storage member 3 is inserted into the inserting groove 11 in the inner wall of the mouthpiece 1.

Step h: installing the metal cover 5. The assembly being assembled in any of steps e to g is locked with the metal cover 5, i.e., the first protrusion 32 on the liquid storage member 3 is inserted into the inserting hole 51 in the metal cover 5.

The use process of the atomizer 100 is as follows:

When the user inhales through the mouthpiece 1, an airflow is generated, the sensor switch is triggered, and the electronic cigarette 200 starts to work. When the electronic cigarette 200 is working, the atomizing core 23 is energized to generate heat, and the atomizing core 23 heats the e-liquid therein to form smoke, the outside air enters the inside of the base 24 through the air inlet passage 243 and then enters the atomizing cavity 216 through one end of the air guiding hole 213. The smoke in the atomizing cavity 216 enters the air guiding tube 6 through the other end of the air guiding hole 213, and the smoke is transported to the mouthpiece 1 through the air guiding tube 6 and discharged out from the mouthpiece 1 for the user to inhale.

In the electronic cigarette 200 provided by this embodiment, the atomizing core 23 is used as the liquid guiding and heating element, the contacting member 22 and the conductive member 231 are in contact with each other to realize the electrical connection between the atomizing core 23 and the contacting member 22. The assembly is simple, the assembly efficiency is improved, and the production cost is reduced.

The above-mentioned embodiments are only preferred embodiments for fully explaining the present application, and the protection scope of the present application is not limited to this. The equivalent substitutions or variations made by technicians in the technical field on the basis of the present application is within the protection scope of the present application. The protection scope of the present application shall be subject to the appended claims.

What is claimed is:

1. An atomizing head comprising a contacting member, an atomizing core and a core seat, wherein an atomizing cavity is formed in the core seat, the atomizing core is connected to the core seat, the atomizing core is a porous ceramic body, a conductive member is provided on the atomizing core, the contacting member is in contact with the conductive member to realize an electrical connection between the contacting member and the atomizing core;

the core seat is provided with a through hole, the through hole is configured to install the atomizing core, and the through hole is in communication with the atomizing cavity; when the atomizing core is inserted in the through hole and installed on the core seat, the atomizing core is at least partially received in the atomizing cavity;

the core seat is provided with a first side surface, a second side surface, a third side surface and a fourth side surface, the area of the first side surface and the second side surface is smaller than that of the third side surface and the fourth side surface, a gap is formed between the first side surface or the second side surface and an inner wall of a liquid storage cavity, while the third side surface and the fourth side surface tightly abut against the inner wall of the liquid storage cavity, the through hole extends through the first side surface and the second side surface of the core seat in a direction perpendicular to an axial direction of the core seat.

2. The atomizing head according to claim 1, wherein the conductive member not only has a conductive function, but also has a heating function, wherein the conductive member comprises an internal circuit, when the contacting member is in contact with the conductive member, the contacting member is electrically connected to the internal circuit, the internal circuit has a certain resistance, and the conductive member generates heat when energized.

3. The atomizing head according to claim 1, wherein the core seat is further provided with an air guiding hole, the air guiding hole is in communication with the atomizing cavity and the outside air; one end of the air guiding hole brings the outside air into the atomizing cavity; after the atomizing core heats and atomizes the e-liquid to form smoke, the smoke in the atomizing cavity is discharged from the other end of the air guiding hole.

4. The atomizing head according to claim 3, wherein the core seat is further provided with a liquid inlet passage, the liquid inlet passage is provided on an outer surface of the core seat, and the liquid inlet passage is in communication with the liquid storage cavity and the through hole.

5. The atomizing head according to claim 4, wherein the liquid inlet passage is provided on an upper end surface of the core seat along an axial direction of the core seat.

6. The atomizing head according to claim 3, wherein the atomizing head further comprises a base, the base is connected to the core seat; the base is provided with a mounting hole, the contacting member is inserted in the mounting hole; the base is further provided with an air inlet passage in communication with the air guiding hole.

7. The atomizing head according to claim 6, wherein an upper end surface of the base is provided with a groove, a bottom of the core seat is provided with an inserting block, and the inserting block is into the groove.

8. The atomizing head according to claim 1, wherein the conductive member is arranged on a surface of the atomizing core.

9. The atomizing head according to claim 8, wherein the conductive member is arranged on a bottom surface of the atomizing core.

10. The atomizing head according to claim 8, wherein the conductive member is a conductive metal layer provided on the surface of the atomizing core.

11. An atomizer comprising a liquid storage member and an atomizing head; wherein the atomizing head comprises a contacting member, an atomizing core and a core seat, an atomizing cavity is formed in the core seat, the atomizing core is connected to the core seat, the atomizing core is a porous ceramic body, a conductive member is provided on the atomizing core, the contacting member is in contact with the conductive member to realize an electrical connection between the contacting member and the atomizing core; a liquid storage cavity is provided in the liquid storage member, the liquid storage cavity is configured for storing e-liquid; the atomizing head is connected to the liquid storage member, and the atomizing head is at least partially received in the liquid storage cavity;

the atomizer further comprises an air guiding tube, one end of the air guiding tube is connected to the liquid storage member, and the other end of the air guiding tube is connected to the core seat, so that the other end of the air guiding tube is in communication with the atomizing cavity; the e-liquid in the liquid storage member is heated and atomized by the atomizing core to form smoke, the smoke is discharged through the air guiding tube for inhalation.

12. The atomizer according to claim 11, wherein the atomizer further comprises a mouthpiece, the mouthpiece is connected to one end of the liquid storage member opposite to the atomizing head, the smoke in the air guiding tube is discharged through the mouthpiece.

13. The atomizer according to claim 12, wherein the liquid storage member is provided with a liquid injecting hole, the liquid injecting hole is provided between the liquid storage member and the mouthpiece, a liquid injecting plug is inserted into the liquid injecting hole to seal the liquid injecting hole.

14. The atomizer according to claim 11, wherein the atomizer further includes a metal cover, the metal cover is sleeved on the bottom end of the liquid storage member.

15. An electronic cigarette comprising a battery assembly and an atomizer according to claim 11; the battery assembly comprises a casing and a battery placed inside the casing, the battery is electrically connected to the contacting member.

16. The electronic cigarette according to claim 15, wherein a supporting frame is provided in the casing, a first magnet is connected to the supporting frame, the atomizer and the battery assembly are in close contact through the attraction force of the first magnet.

* * * * *